US008721018B2

(12) United States Patent
Yamashita

(10) Patent No.: US 8,721,018 B2
(45) Date of Patent: May 13, 2014

(54) PIEZOELECTRIC ACTUATOR APPARATUS AND INK-JET PRINTER

(75) Inventor: Toru Yamashita, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 293 days.

(21) Appl. No.: 13/070,939

(22) Filed: Mar. 24, 2011

(65) Prior Publication Data

US 2011/0292107 A1 Dec. 1, 2011

(30) Foreign Application Priority Data

May 31, 2010 (JP) ..... 2010-125158

(51) Int. Cl.
*B41J 29/38* (2006.01)

(52) U.S. Cl.
CPC ..... *B41J 29/38* (2013.01)
USPC ..... 347/10

(58) Field of Classification Search
CPC ..... B41J 29/38
See application file for complete search history.

(56) References Cited

U.S. PATENT DOCUMENTS

| | | | | |
|---|---|---|---|---|
| 2005/0219280 | A1* | 10/2005 | Hiwada et al. | 347/5 |
| 2006/0055745 | A1* | 3/2006 | Yagi | 347/71 |
| 2008/0238974 | A1* | 10/2008 | Takahashi | 347/14 |
| 2009/0085953 | A1* | 4/2009 | Ito | 347/19 |
| 2010/0079553 | A1* | 4/2010 | Katoh | 347/68 |

FOREIGN PATENT DOCUMENTS

| | | |
|---|---|---|
| JP | 7-128387 | 5/1995 |
| JP | 2005/289013 | 10/2005 |
| JP | 2006-88446 | 4/2006 |
| JP | 2008-168565 | 7/2008 |
| JP | 2010-76329 | 4/2010 |

OTHER PUBLICATIONS

Notice of Reasons for Rejection for Japanese for Patent Application No. 2010-125158 dated Sep. 17, 2013.

* cited by examiner

*Primary Examiner* — Geoffrey Mruk
*Assistant Examiner* — Bradley Thies
(74) *Attorney, Agent, or Firm* — Frommer Lawrence & Haug LLP

(57) ABSTRACT

A piezoelectric actuator apparatus which is connectable to a power supply includes: a piezoelectric actuator which is provided with a plurality of piezoelectric elements each of which is sandwiched by two types of electrodes; a drive device which is connected to the power supply to drive each of the piezoelectric elements by changing a voltage between the two types of electrodes; a comparison section which compares a predetermined reference value with one of a supply voltage from the power supply to the drive device and an electric current flowing between the power supply and the drive device under the condition that the drive device applies the voltage to at least one piezoelectric element of the piezoelectric elements; and a judgement section which judges a degradation degree of dielectric strength voltage for the at least one piezoelectric element based on a comparison by the comparison section.

13 Claims, 11 Drawing Sheets

PIEZOELECTRIC ACTUATOR APPARATUS AND INK-JET PRINTER

CROSS REFERENCE TO RELATED APPLICATION

The present application claims priority from Japanese Patent Application No. 2010-125158, filed on May 31, 2010, the disclosure of which is incorporated herein by reference in its entirety.

BACKGROUND OF THE INVENTION

1. Field of the Invention

The present invention relates to a piezoelectric actuator apparatus, and an ink-jet printer provided with the piezoelectric actuator apparatus.

2. Description of the Related Art

Conventionally, piezoelectric actuators, which drive objects by utilizing piezoelectric deformation (also referred to as piezoelectric strain) in the piezoelectric layer, have been widely used in various technical fields. Among those actuators, U.S. Patent Application Publication No. 2005/0219280 (corresponding to Japanese Patent Application Laid-Open No. 2005-289013) discloses a piezoelectric actuator which is usable in ink-jet heads.

The piezoelectric actuator described in U.S. Patent Application Publication No. 2005/0219280 is provided on a flow passage unit of an ink-jet head including a plurality of pressure chambers each communicating with a plurality of nozzles, and applies a pressure to the ink inside the pressure chambers respectively so as to jet ink droplets from the nozzles. More specifically, the piezoelectric actuator of U.S. Patent Application Publication No. 2005/0219280 has a piezoelectric layer (piezoelectric sheet) arranged to cover the plurality of pressure chambers of the flow passage unit, and two types of electrodes (a plurality of individual electrodes and a common electrode) provided on both surfaces of the piezoelectric layer, respectively. The plurality of individual electrodes are provided to overlap the plurality of pressure chambers respectively, and the common electrode commonly faces the plurality of individual electrodes sandwiching the piezoelectric layer therebetween. In this configuration, when a drive device (driver IC) applies a voltage between the individual electrodes and the common electrode, piezoelectric deformation occurs in a plurality of portions of the piezoelectric layer (piezoelectric elements) sandwiched between the plurality of individual electrodes and the common electrode, thereby applying a pressure to the ink inside the pressure chambers.

However, in the piezoelectric actuator described hereinabove, degradation of dielectric strength voltage sometimes occurs in the piezoelectric elements sandwiched between the two types of electrodes. For example, if a voltage is applied between the electrodes in a state that there is a crack in the piezoelectric element, migration may occur and develop along the crack. Further, if a voltage is applied in a state that water or moisture is absorbed in the crack, water tree phenomenon may occur and develop, thereby causing dielectric strength voltage to degrade in the piezoelectric element. Then, such degradation of dielectric strength voltage may be advanced due to continuous voltage application between the electrodes, and may finally cause a short circuit between the electrodes.

The piezoelectric actuator of U.S. Patent Application Publication No. 2005/0219280 is configured such that liquid droplets are jetted from each of the nozzles by a series of processes including applying a voltage to each of the piezoelectric elements as a standby state, releasing the application of the voltage, and applying the voltage again. Therefore, the voltage is also applied to the piezoelectric elements in an unutilized state (not causing jetting of the liquid droplets from the nozzles), that is, in the standby state. In view of this, in the piezoelectric actuator of U.S. Patent Application Publication No. 2005/0219280, in order to restrain the migration phenomenon from developing due to the same voltage application in the standby state, when only black nozzles are utilized to print a text, for example, the voltage is not applied to the piezoelectric elements (individual electrodes) for color nozzles which do not jet liquid droplets, so as to shorten the time of applying the voltage to each piezoelectric element.

In the piezoelectric actuator of U.S. Patent Application Publication No. 2005/0219280, in order to prevent a short circuit from occurring between the electrodes due to the progress of migration, the voltage is not applied to the unutilized piezoelectric elements thereby shortening the application time of the voltage. However, because it is not possible to specify which piezoelectric elements have a defect, it is not possible to individually shorten the application time of the voltage for the piezoelectric elements with the defects.

Further, as described hereinabove, the degradation of dielectric strength voltage in piezoelectric elements caused by migration and the like does not cause a complete short circuit between the electrodes in a short period of time after its occurrence, but it progresses gradually due to a continuous voltage application to the piezoelectric elements after the occurrence. Therefore, from the point of view of improving the product life, it is preferable to take an appropriate measure to prolong the life of the piezoelectric elements before they become degraded in dielectric strength voltage, that is, before they get into a state that a complete sort circuit has occurred between the electrodes and the piezoelectric elements become unusable.

SUMMARY OF THE INVENTION

Accordingly, an object of the present invention is to provide a piezoelectric actuator apparatus capable of perceiving the degree of dielectric strength voltage for each of a plurality of piezoelectric elements and thereby taking an appropriate measure for the piezoelectric elements which are degrading in dielectric strength voltage so as to prolong their life.

According to a first aspect of the present invention, there is provided a piezoelectric actuator apparatus which is connectable to a power supply, the apparatus including: a piezoelectric actuator which is provided with a plurality of piezoelectric elements each of which is sandwiched by two types of electrodes; a drive device which is connected to the power supply to drive each of the piezoelectric elements by applying drive pulse signals; a comparison section which compares a predetermined reference value with one of a supply voltage from the power supply to the drive device and an electric current flowing between the power supply and the drive device under the condition that the drive device applies the drive pulse signals to at least one piezoelectric element of the piezoelectric elements; and a judgement section which judges a degradation degree of dielectric strength voltage for the at least one piezoelectric element based on a comparison by the comparison section.

According to a second aspect of the present invention, there is provided an ink-jet printer which is connectable to a power supply and which jets ink droplets to a recording medium, the ink-jet printer including: an ink-jet head including a flow passage unit which has a plurality of nozzles for jetting the ink droplets toward the recording medium and ink flow passages communicating with the nozzles, and a piezoelectric actuator which is provided on the flow passage unit and which has a plurality of piezoelectric elements each of which is sandwiched by two types of electrodes to cause the ink droplets to be jetted from the nozzles; a drive device which is connected to the power supply to drive each of the piezoelectric elements by applying drive pulse signals; a comparison section which compares a predetermined reference value with one of a supply voltage from the power supply to the drive device and an electric current flowing between the power supply and the drive device under the condition that the drive device applies the drive pulse signals to at least one piezoelectric element of the piezoelectric elements; and a judgement section which judges a degradation degree of dielectric strength voltage for the at least one piezoelectric element based on a comparison by the comparison section.

In a piezoelectric element degrading in dielectric strength voltage, when a voltage is applied between the two types of electrodes sandwiching the piezoelectric element, an electric current flows in the piezoelectric element which was originally dielectric. Therefore, during the time of applying the voltage only to such piezoelectric elements, signs such as drop in the supply voltage from the power supply to the drive device, or the electric current flowing between the power supply and the drive device may appear. Further, the more the dielectric strength voltage degrades, the more the electric current flows through the piezoelectric element. This causes changes in the value of the supply voltage or the electric current between the power supply and the drive device. In view of this, in the present invention, the comparison section compares a predetermined reference value with one of the supply voltage from the power supply to the drive device and the electric current flowing between the power supply and the drive device when the voltage is applied to at least one piezoelectric element of the plurality of piezoelectric elements. Based on the comparison results, the judgement section judges a degradation degree of dielectric strength voltage for the at least one piezoelectric element. In this manner, by judging the degradation degree of dielectric strength voltage for the at least one of the piezoelectric elements, it is possible to take measures for the piezoelectric elements which are degrading in dielectric strength voltage but have not yet been completely short-circuited to restrain the degradation of dielectric strength voltage and thereby prolonging the life of the piezoelectric elements.

DESCRIPTION OF THE PREFERRED EMBODIMENT

Hereinbelow, explanations will be made with respect to a preferred embodiment of the present invention. The embodiment is an example of applying the present invention to an ink-jet printer provided with an ink-jet head for jetting ink droplets to a recording paper.

Figure 1:
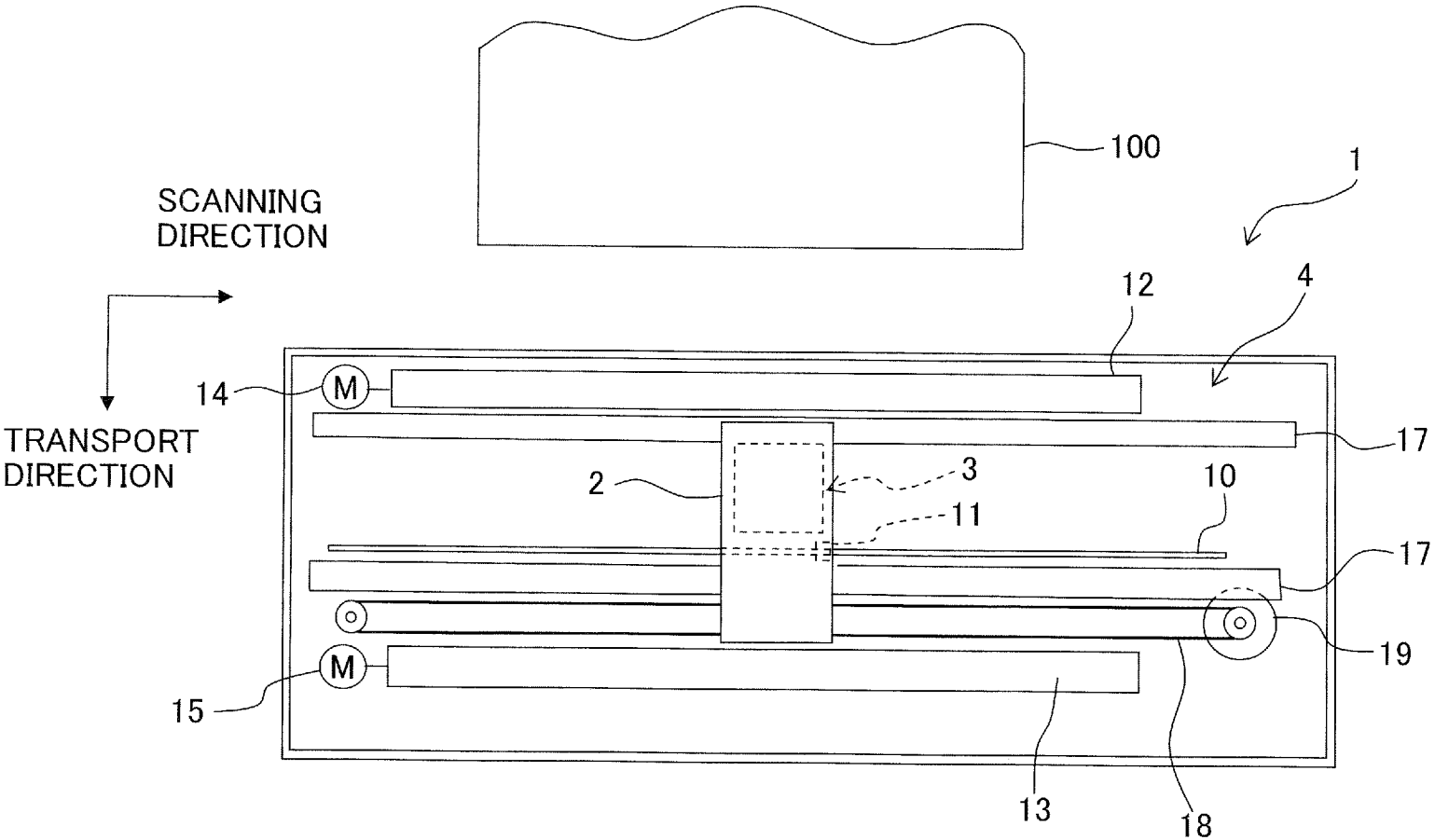
FIG. 1 is a plan view schematically showing an ink-jet printer in accordance with an embodiment of the present invention.

First, explanations will be made with respect to a schematic configuration of an ink-jet printer 1 in accordance with the embodiment. As shown in FIG. 1, the printer 1 includes a carriage 2 configured to be movable in a reciprocating manner in a predetermined scanning direction (a left-right direction of FIG. 1), an ink-jet head 3 installed on the carriage 2, a transport mechanism 4 for transporting a recording paper 100 as a recording medium in a transport direction perpendicular to the scanning direction, and the like.

The carriage 2 is configured to be movable in a reciprocating manner along two guide shafts 17 extending parallel to the scanning direction (left-right direction of FIG. 1). Further, the carriage 2 is connected to an endless belt 18 and thus moves along with the movement of the endless belt 18 in the scanning direction when the endless belt 18 is driven to move by a carriage drive motor 19. Further, the printer 1 is provided with a linear encoder 10 having a number of light transmission portions (slits) aligned at intervals in the scanning direction. On the other hand, the carriage 2 is provided with a transmission-type photosensor 11 having light-emitting elements and light-receiving elements. Then, the printer 1 recognizes a present position of the carriage 2 in the scanning direction from a count value (the number of times detected) of the light transmission portions of the linear encoder 10 detected by the photosensor 11 during the movement of the carriage 2.

The ink-jet head 3 is installed on the carriage 2, and includes a plurality of nozzles 30 (see FIGS. 2 to 4A and 4B) in the lower surface (on the back side of the page of FIG. 1). The ink-jet head 3 is configured to jet the ink supplied from an ink cartridge (not shown) from the plurality of nozzles 30 to the recording paper 100 transported by the transport mechanism 4 toward the lower side of FIG. 1 (in the transport direction).

The transport mechanism 4 has a paper feeding roller 12 arranged on the upstream side in the transport direction with respect to the ink-jet head 3, and a paper discharging roller 13 arranged on the downstream side in the transport direction with respect to the ink-jet head 3. The paper feeding roller 12 and the paper discharging roller 13 are driven to rotate by a paper feeding motor 14 and a paper discharging motor 15, respectively. Then, the transport mechanism 4 transports the recording paper 100 from the upper side of FIG. 1 toward the ink-jet head 3 by means of the paper feeding roller 12 and, at the same time, discharges the recording paper 100, on which images, characters, and the like have been recorded by the ink jet head 3, to the lower side of FIG. 1 by means of the paper discharging roller 13.

Next, the ink-jet head 3 will be explained. As shown in FIGS. 2 to 4A and 4B, the ink-jet head 3 has a flow passage unit 6 in which ink flow passages including the nozzles 30 and pressure chambers 24 are formed, and a piezoelectric actuator 7 which applies a pressure to the ink inside the pressure chambers 24.

Figure 4A:
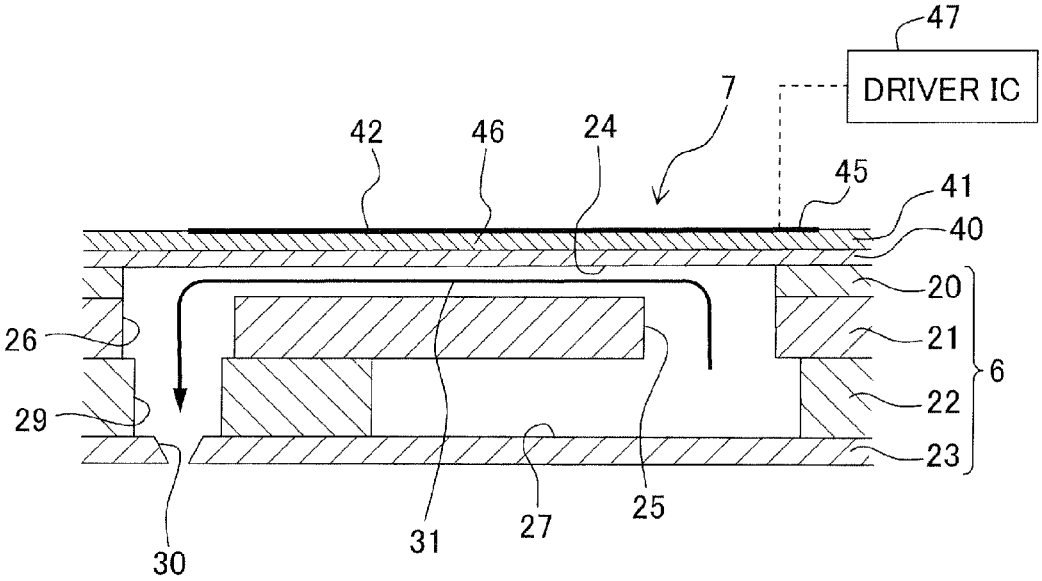
FIG. 4A is a cross-sectional view taken along the line IV A-IV A of FIG. 3.
Figure 4B:
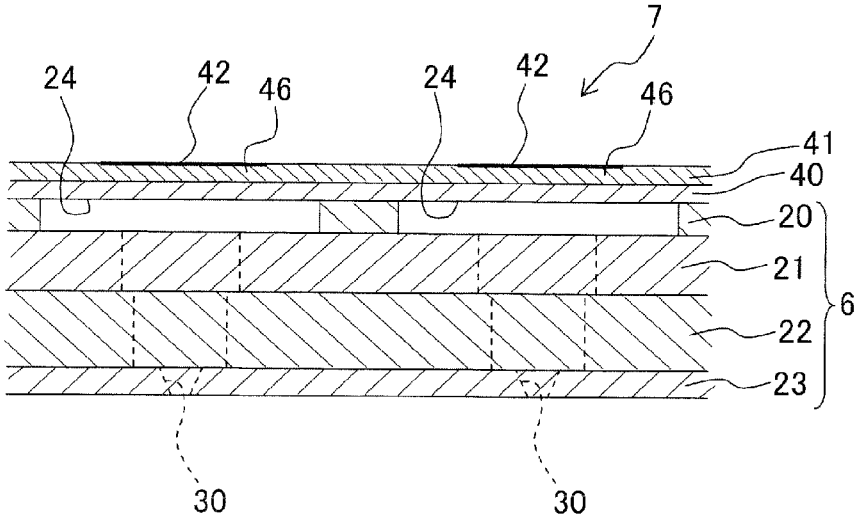
FIG. 4B is a cross-sectional view taken along the line IV B-IV B of FIG. 3.

First, the flow passage unit 6 will be explained. As shown in FIGS. 4A and 4B, the flow passage unit 6 includes a cavity plate 20, a base plate 21, a manifold plate 22, and a nozzle plate 23. These four plates 20 to 23 are joined together in a stacked state. Among them, the cavity plate 20, the base plate 21, and the manifold plate 22 are, in a plane view, approximately rectangular plates formed of a metallic material such as stainless steels and the like, respectively. Therefore, it is possible to easily form the ink flow passages such as manifolds 27, the pressure chambers 24, and the like which will be described hereinafter in these three plates 20 to 22 by etching. Further, the nozzle plate 23 is formed of a high polymer synthetic-resin material such as polyimide and the like, and adhered to the lower surface of the manifold plate 22 by an adhesive. Alternatively, the nozzle plate 23 may also be formed of a metallic material such as stainless steels and the like in the same manner as the other three plates 20 to 22.

As shown in FIGS. 2 to 4A and 4B, in the cavity plate 20 positioned on the uppermost side among the four plates 20 to 23, the plurality of pressure chambers 24 aligned along the surface are formed by a plurality of holes each of which penetrates the plate 20. Further, the plurality of pressure chambers 24 are aligned in a plurality of rows (an aspect of two rows is shown as an example for simplification) in a zigzag manner in the transport direction (an up-down direction of FIG. 2). Further, as shown in FIGS. 4A and 4B, the plurality of pressure chambers 24 are covered by a vibration plate 40 which will be described later and the base plate 21 from the upper side and the lower side, respectively. Furthermore, each of the pressure chambers 24 is formed to be approximately elliptical and, in a plane view, elongated in the scanning direction (the left-right direction of FIG. 2).

Figure 2:
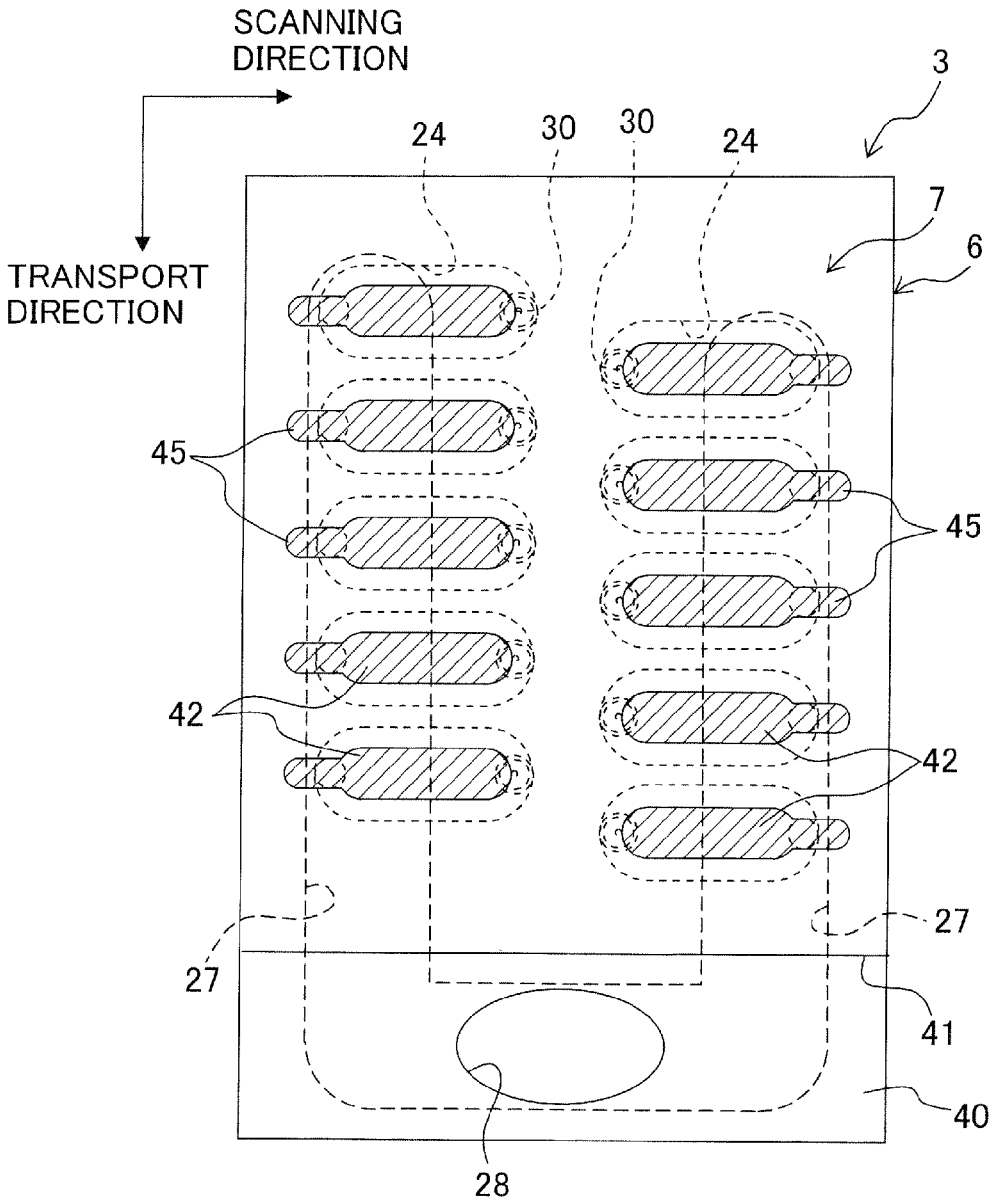
FIG. 2 is a plan view of an ink-jet head.
Figure 3:
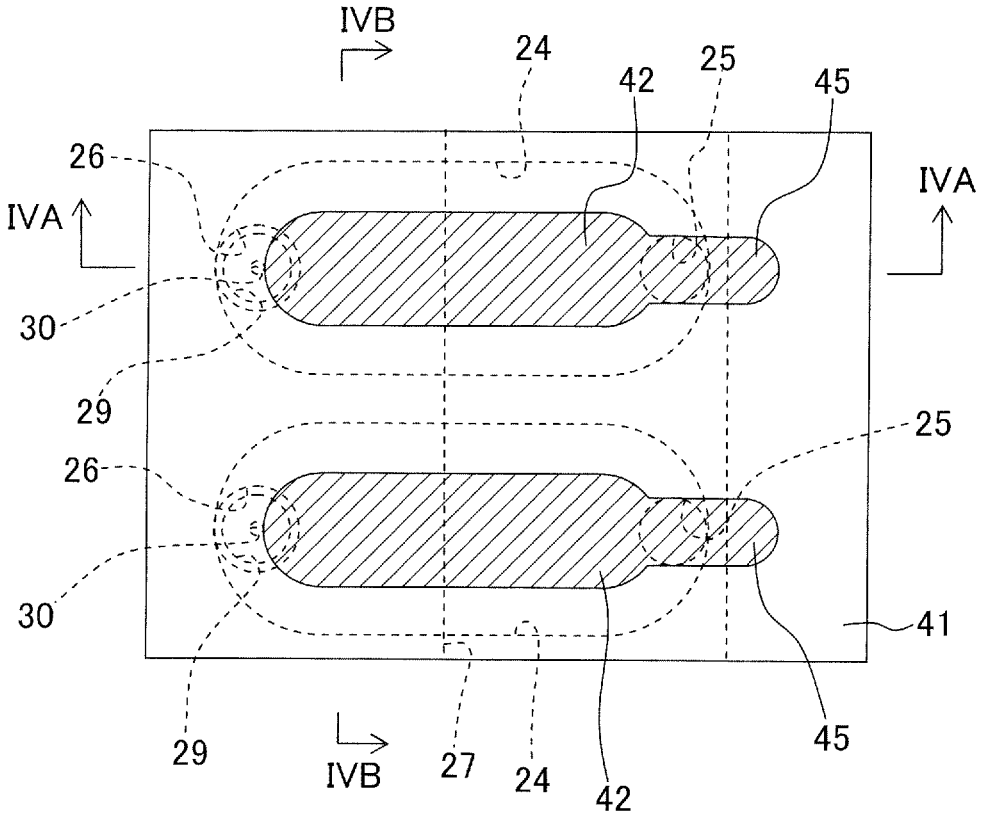
FIG. 3 is a partial enlarged view of FIG. 2.

As shown in FIGS. 3 and 4A and 4B, communication holes 25 and 26 are formed in the base plate 21 at the positions which respectively overlap the two longitudinal end portions of each pressure chamber 24, in a plane view. Further, in the manifold plate 22, a plurality of manifolds 27 (two in FIG. 2) are formed to extend in the transport direction so as to overlap the portions of the pressure chambers 24 aligned in two rows on the side of the communication holes 25, in a plane view. These plurality of manifolds 27 are in communication with an ink supply port 28 formed in the vibration plate 40 of the piezoelectric actuator 7 to supply ink to the manifolds 27 through the ink supply port 28 from an ink tank (not shown). Further, a plurality of communication holes 29 each of which communicates with one of the plurality of communication holes 26 are also formed in respective connection in the manifold plate 22 at the positions which respectively overlap the end portions of the plurality of pressure chambers 24 on the opposite side to the manifolds 27, in a plane view.

Further, the plurality of nozzles 30 are formed in the nozzle plate 23 at the positions which respectively overlap the plurality of communication holes 29, in a plane view. As shown in FIG. 2, the plurality of nozzles 30 are arranged to respectively overlap the end portions of the plurality of pressure chambers 24 aligned in two rows in the transport direction on the opposite side to the manifolds 27 to form a plurality of nozzle rows (two rows in FIG. 2).

As described hereinabove and shown in FIGS. 4A and 4B, the manifolds 27 communicate with the pressure chambers 24 via the communication holes 25 and, furthermore, the pressure chambers 24 communicate with the nozzles 30 via the communication holes 26 and 29. In this manner, inside the flow passage unit 6, a plurality of individual ink flow passages 31 are formed from the manifolds 27 through the pressure cambers 24 to the nozzles 30.

Further, in FIG. 2, in order to simplify the explanations, only one kind of flow passage structure (the manifolds 27, pressure chambers 24, nozzles 30, and the like) is depicted to be in connection with one ink supply port 28. However, the ink-jet head 3 may also be a color ink-jet head which is configured such that a plurality of the flow passage structures shown in FIG. 2 are provided to align in the scanning direction, and thereby capable of respectively jetting multicolor inks (for example, four colors: black, yellow, cyan, and magenta).

Next, the piezoelectric actuator 7 will be explained. As shown in FIGS. 2 to 4A and 4B, the piezoelectric actuator 7 includes the vibration plate 40 which is arranged on the upper surface of the flow passage unit 6 (the cavity plate 20) to cover the plurality of pressure chambers 24, a piezoelectric layer 41 which is arranged on the upper surface of the vibration plate 40 to face the plurality of pressure chambers 24, and a plurality of individual electrodes 42 which are arranged on the upper surface of the piezoelectric layer 41.

The vibration plate 40 is, in a plane view, an approximately rectangular metallic plate which is, for example, formed of a ferrous alloy such as stainless steels and the like, a copper alloy, nickel alloy, titanium alloy, or the like. This vibration plate 40 is adhered to the cavity plate 20 in a state of being arranged on the upper surface of the cavity plate 20 to cover the plurality of pressure chambers 24. Further, the upper surface of the conductive vibration plate 40 is arranged on the lower surface side of the piezoelectric layer 41 to also act as a common electrode for generating an electric field in the piezoelectric layer 41 in its thickness direction between the plurality of individual electrodes 42 on the upper surface of the piezoelectric layer 41 and the common electrode. As the common electrode, the vibration plate 40 is connected to the ground wire of a driver IC 47 which will be described hereinafter to be constantly maintained at the ground potential.

The piezoelectric layer 41 is plate-shaped and formed of a piezoelectric material composed mainly of lead zirconium titanate (PZT) which is a ferroelectric and a solid solution of lead titanate and lead zirconate. As shown in FIGS. 2 and 4B, the piezoelectric layer 41 is formed continuously on the upper surface of the vibration plate 40 to cover the plurality of pressure chambers 24.

The plurality of individual electrodes 42 are arranged on the upper surface of the piezoelectric layer 41 in the areas facing the plurality of pressure chambers 24, respectively. Each of the individual electrodes 42 has a planar shape of an approximate ellipse which is slightly smaller than a pressure chamber 24 and faces the central portion of a pressure chamber 24. That is, the plurality of individual electrodes 42 are arranged to be spaced apart from each other to correspond to the plurality of pressure chambers 24, respectively. Further, from end portions of the plurality of individual electrodes 42, a plurality of contact portions 45 extend out, respectively, in the longitudinal direction of the individual electrodes 42 to be connected to a flexible wiring board (not shown) on which the driver IC 47 is installed.

Further, a plurality of portions in the piezoelectric layer (active portions 46) are sandwiched between the plurality of individual electrodes 42 and the vibration plate 40 as the common electrode. Those active portions are preliminarily polarized in the thickness direction of the piezoelectric layer 41. Then, when a potential difference (voltage) is generated between an individual electrode 42 and the vibration plate 40, a piezoelectric deformation (piezoelectric strain) occurs in the active portion 46 and, because of this deformation, a pressure is applied to the ink inside the pressure chamber 24 facing that active portion 46. That is, one active portion 46 corresponds to one piezoelectric element according to the present invention for applying a jetting pressure to the ink in one pressure chamber 24 and jetting ink droplets from one of the nozzles 30.

The flexible wiring board (FPC, not shown), on which the driver IC 47 (drive device) for driving the piezoelectric actuator 7 is installed, is connected to the piezoelectric actuator 7 and, via the wires on the FPC, the driver IC 47 is electrically connected with the plurality of individual electrodes 42 and the vibration plate 40 as the common electrode. Further, the driver IC 47 is also connected with a control device 8 (see FIG. 5) and a power supply of the printer 1 (not shown) via the FPC. Then, receiving instructions from the control device 8, the driver IC 47 supplies drive pulse signals (see FIGS. 6A to 6C), which will be described later and each of which has a predetermined pulse waveform and voltage level (wave-height value), to the individual electrodes 42 to cause a change in the potential difference between the individual electrodes 42 and the vibration plate 40 constantly maintained at the ground potential, that is, a change in the voltage applied to the active portions 46.

Next, explanations will be made with respect to the behavior of each of the active portions 46 of the piezoelectric actuator 7 when a drive pulse signal is supplied. When the driver IC 47 supplies a drive pulse signal (FIGS. 6A to 6C) to a certain individual electrode 42, a voltage is applied to the active portion 46 sandwiched between that individual electrode 42 and the vibration plate 40 as the common electrode constantly maintained at the ground potential, and an electric field is generated in the active portion 46 in the thickness direction of the active portion 46. Since the direction of the electric field is parallel to the polarization direction of the active portion 46, the active portion 46 contracts in a planar direction perpendicular to the thickness direction. Here, since the vibration plate 40 under the piezoelectric layer 41 is fixed on the cavity plate 20, the vibration plate 40 deforms in the portion covering the pressure chamber 24 to become convex toward the side of the pressure chamber 24 (unimorph deformation) along with the contraction in the planar direction occurring in the piezoelectric layer 41 positioned on the upper surface of the vibration plate 40. At the time, because internal volume of the pressure chamber 24 is decreased, the ink pressure increases inside the pressure chamber 24, and thereby the ink is jetted from the nozzle 30 in communication with that pressure chamber 24.

Figure 5:
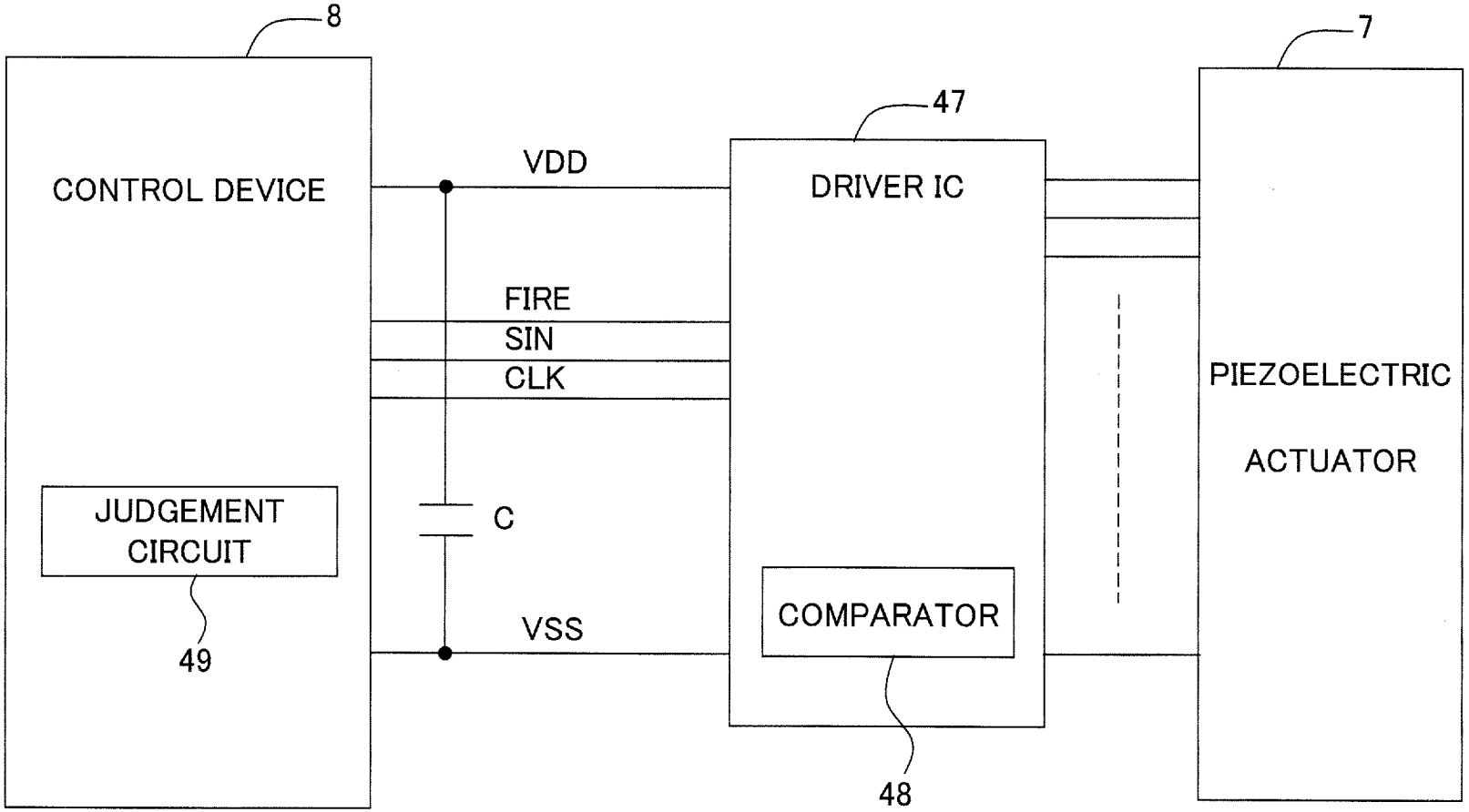
FIG. 5 is a diagram showing an electrical connection configuration of a piezoelectric actuator, a driver IC and a control device.
Figure 6A:
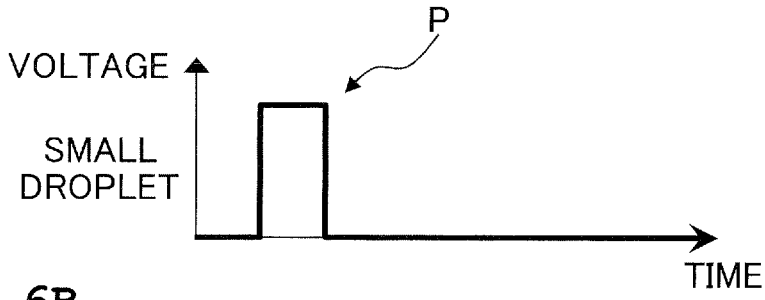
FIGS. 6A to 6C are waveform diagrams of drive pulse signals to be supplied from the driver IC to the piezoelectric actuator.
Figure 6B:
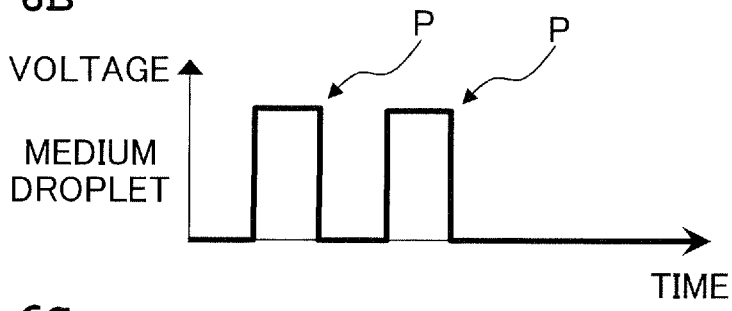
Figure 6C:
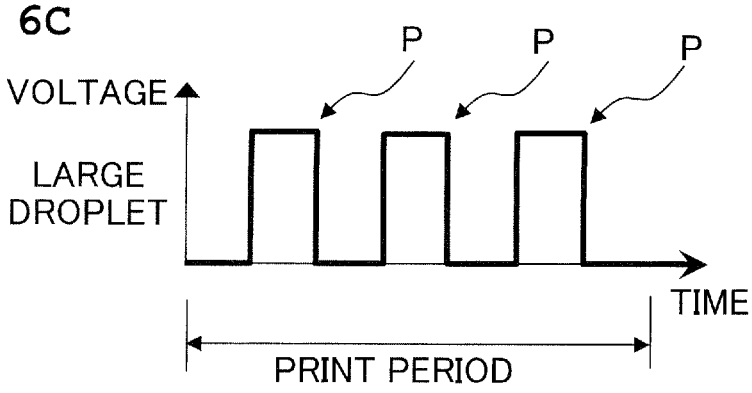

Next, explanations will be made in detail with respect to the driver IC 47 (drive device) for supplying a drive pulse signal to the piezoelectric actuator 7. As shown in FIG. 5, the driver IC 47 is connected with the control device 8 and supplies the drive pulse signals each having a predetermined waveform to the individual electrodes 42 of the piezoelectric actuator 7 based on the signals supplied from the control device 8. FIGS. 6A to 6C show three different types of drive pulse signals, respectively. The driver IC 47 selects one of the three types of pulse signals shown in FIGS. 6A to 6C to supply the same to each of the active portions 46 (individual electrode 42). These three types of signals serve to jet three types of liquid droplets different in size (small droplet, medium droplet, and large droplet) from one nozzle 30 so as to enable a multi-gradation printing, and differ in pulse waveform from each other. More specifically, as shown in FIGS. 6A to 6C, the three types of drive pulse signals are different in the number of pulses P included in one print period (a period during which one dot is formed on the recording paper 100).

As shown in FIG. 5, the control device 8 and the driver IC 47 are connected by two power wires (VDD: power-supply voltage, and VSS: ground), and the driver IC 47 is connected to the power supply of the printer 1 (not shown) via the control device 8. Further, to the driver IC 47, the control device 8 inputs a clock (CLK), waveform data of the three types of drive pulse signals (FIRE), a waveform selection signal (SIN) for selecting one of the three types of waveforms, and the like. Then, the driver IC 47 selects one of the three types of waveform data (FIRE) based on the waveform selection signal (SIN) transmitted from the control device 8 according to the clock, generates a drive pulse signal having the selected waveform, and supplies the same to each of the individual electrodes 42 of the piezoelectric actuator 7.

Further, as shown in FIG. 5, inside the driver IC 47, a comparator 48 is provided to compare the supply voltage (VDD voltage) from the power supply to the driver IC 47 with a predetermined reference voltage to output a comparison signal. This comparator 48 is provided for detecting the degradation degree of dielectric strength voltage in each of the plurality of active portions 46 of the piezoelectric actuator 7. The details of the comparator 48 will be described hereinafter.

Figure 7:
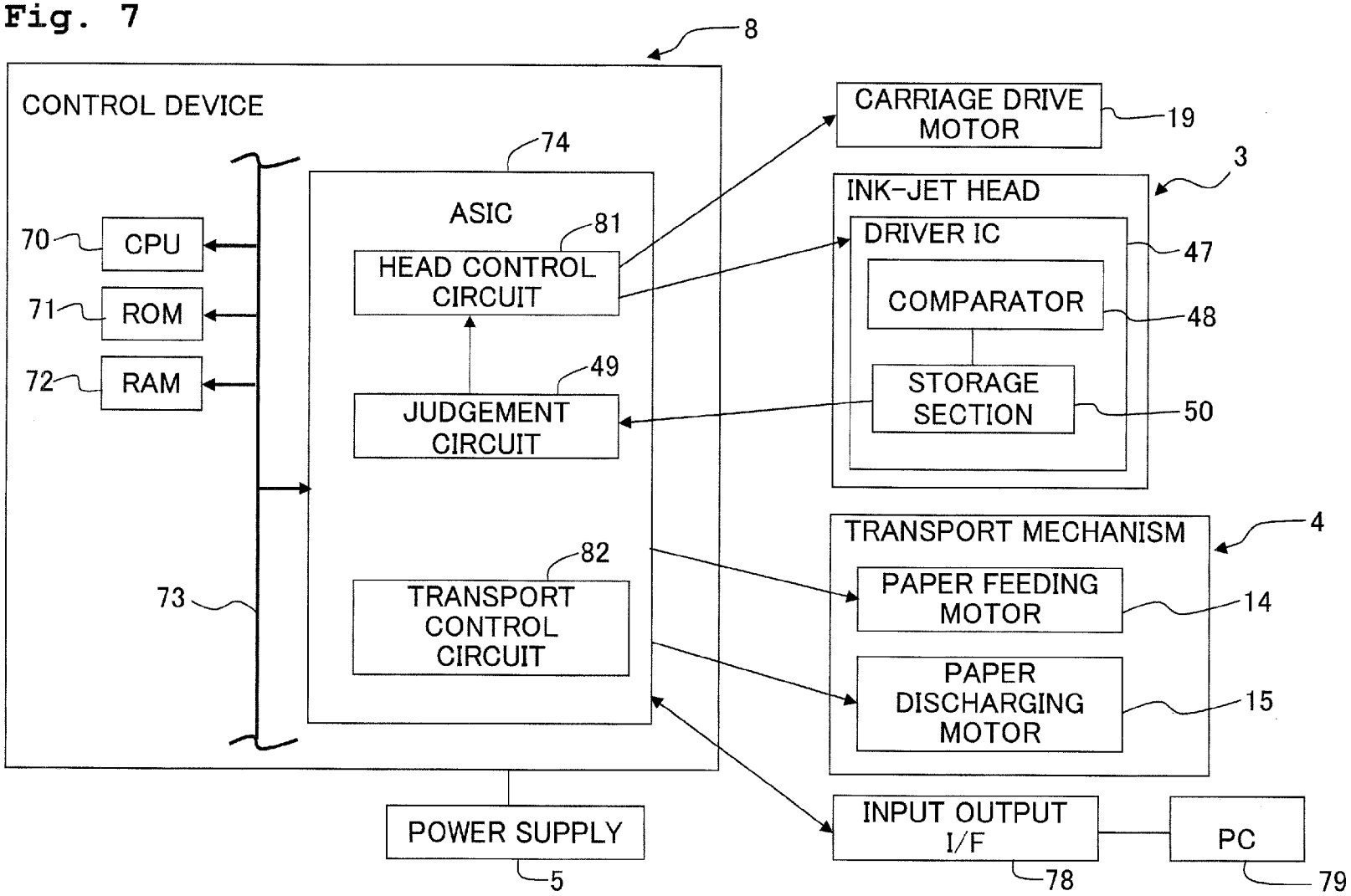
FIG. 7 is a block diagram schematically showing an electrical configuration of the ink-jet printer.

Next, explanations will be made with respect to an electrical configuration of the printer 1 with a focus on the control device 8 in reference to the block diagram of FIG. 7. As shown in FIG. 7, the control device 8 has a microcomputer composed of a CPU (Central Processing Unit) 70, a ROM (Read Only Memory) 71, a RAM (Random Access Memory) 72, and a bus 73 connecting these components. Further, an ASIC (Application Specific Integrated Circuit) 74 is connected to the bus 73 to control the driver IC 47 of the ink-jet head 3, the carriage drive motor 19 for driving the carriage 2, the paper feeding motor 14 and paper discharging motor 15 of the transport mechanism 4, and the like. Further, the ASIC 74 is connected to an external PC (Personal Computer) 79 in such a manner that data communications are possible therebetween via an input-output interface (I/F) 78.

Further, the following circuits are incorporated into the ASIC 74: a head control circuit 81 for controlling the driver IC 47 of the ink-jet head 3 and the carriage drive motor 19 respectively based on an image data inputted from the PC 79, a transport control circuit 82 for controlling the paper feeding motor 14 and paper discharging motor 15 of the transport mechanism 4 respectively in the same manner based on the image data, and the like.

The head control circuit 81 generates the waveform selection signal (SIN) for selecting one of the three types of drive pulse signals (see FIGS. 6A to 6C) for each of the plurality of active portions 46 (individual electrodes 42) corresponding to the plurality of nozzles 30 based on the image data from the PC 79. Further, it transmits the waveform data (FIRE) of the three types of drive pulse signals and the waveform selection signal (SIN) to the driver IC 47. Then, the driver IC 47 generates a drive pulse signal in accordance with the waveform selection signal for the plurality of individual electrodes 42, and supplies the same to each of the plurality of individual electrodes 42.

However, in the active portions 46 of the piezoelectric actuator 7 described hereinbefore (between the individual electrodes 42 and the vibration plate 40 as the common electrode), degradation of dielectric strength voltage may occur due to the migration phenomenon, water tree phenomenon, and the like. For example, in the unimorph-type piezoelectric actuator 7 of the embodiment shown in FIGS. 4A and 4B, although it is preferable to make the piezoelectric layer 41 as thin as possible for improving the efficiency of deformation, cracks may easily occur in such a thin piezoelectric layer 41, and the cracks cause migration to occur in the thickness direction along the cracks between the individual electrodes 42 and the common electrode (vibration plate 40).

However, the degradation of dielectric strength voltage in the active portions 46 due to migration and the like gradually advances by a continuous voltage application to the active portions 46 after its occurrence. Therefore, if such a sign is detectable in a certain active portion 46 before the degradation of dielectric strength voltage becomes advanced and thereby causes a complete short circuit to occur between the individual electrode 42 and the vibration plate 40 becomes unusable, it is possible to take an appropriate measure for that active portion 46 to prolong its life. In view of this, in the embodiment, the degradation degree of dielectric strength voltage is judged at a plurality of levels for each of the plurality of active portions 46, and then the method for driving the active portions 46 is changed according to the level.

Figure 8:
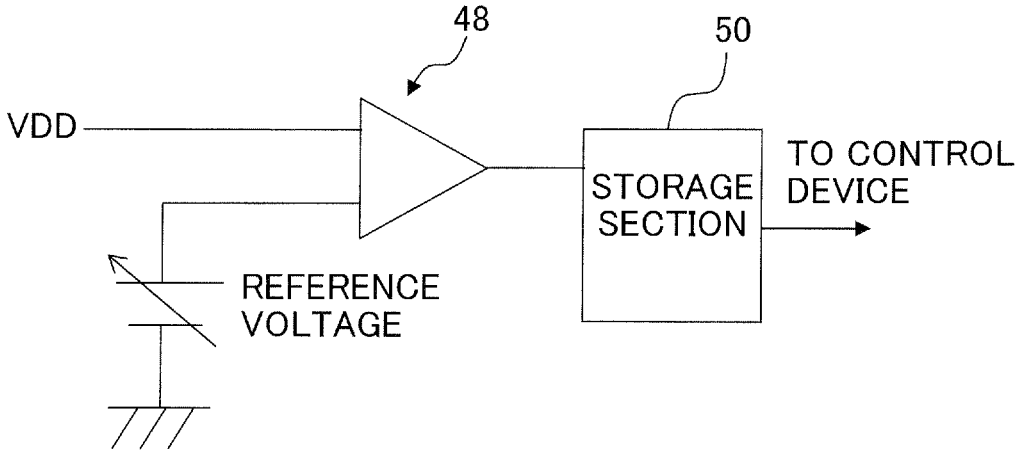
FIG. 8 is a circuit diagram of a comparator and a storage section.

Hereinbelow, descriptions will be made with respect to a configuration for judging the degradation degree of dielectric strength voltage in each active portion 46 and a specific judgement method in reference to FIGS. 5, 7, 8, and 11. As shown in FIGS. 5 and 7, the driver IC 47 is provided with the comparator 48 (comparison section) for comparing the supply voltage (VDD voltage) from the power supply to the driver IC 47 with a plurality of types of reference voltages at the time of applying a voltage only to one active portion 46, and a storage section 50 for storing the comparison results outputted from the comparator 48. FIG. 8 is a circuit diagram of the comparator 48 and the storage section 50. Further, on the side of the control device 8, a judgement circuit 49 (judgement section) is provided for judging the degradation degree of dielectric strength voltage in the active portions 46 from the comparison results of the comparator 48.

Figure 11:
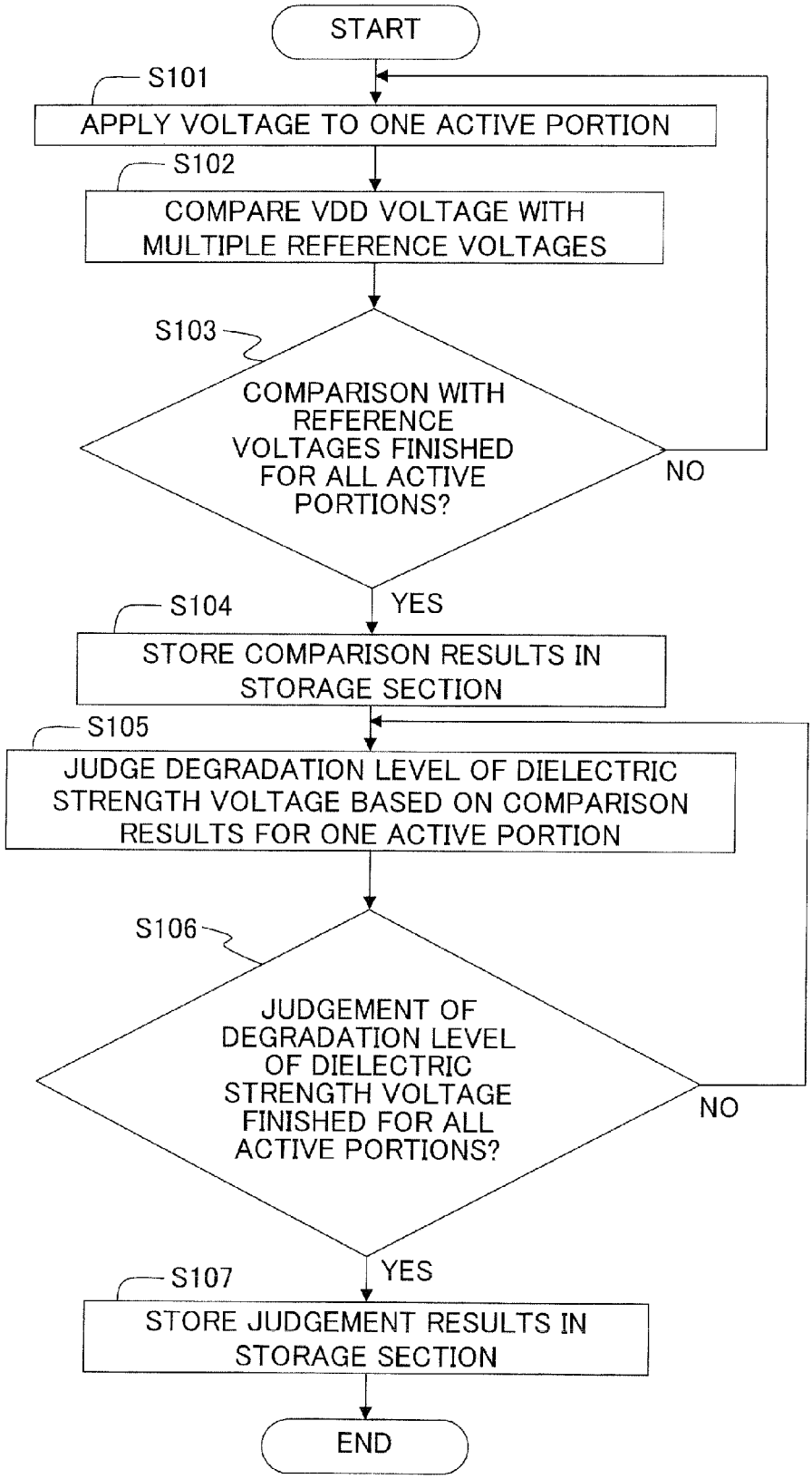
FIG. 11 is a flowchart showing a process of judging a degradation level of dielectric strength voltage.

At the time of judging the degradation level of dielectric strength voltage in the plurality of active portions 46, the driver IC 47 applies the voltage to the individual electrodes 42 one by one for each of the plurality of active portions 46 (the step S101 of FIG. 11). That is, it applies the voltage only to the individual electrode 42 of the one active portion 46 to be examined, but does not apply the voltage to the other active portions 46 at the same time. At the time, the voltage (potential difference) is generated not only between the individual electrode 42 of the active portion 46 to be examined and the vibration plate 40 but also between the individual electrode 42 of the active portion 46 to be examined and other adjacent individual electrodes 42.

At the time of applying the voltage only to one of the plurality of active portions 46, if that active portion 46 is a normal active portion without degradation of dielectric strength voltage, then the supply voltage (the VDD voltage of FIG. 5) from the power supply to the driver IC 47 only changes slightly at an early stage of applying the voltage to the one active portion 46 (at the time of charging), but almost does not change thereafter. However, if the dielectric strength voltage is degrading in the active portion 46, an electric current may keep flowing between the individual electrode 42 and the vibration plate 40 (common electrode) which sandwich that active portion 46 and cause a voltage drop. Therefore, the supply voltage from the power supply to the driver IC 47 becomes lower.

Figure 9:
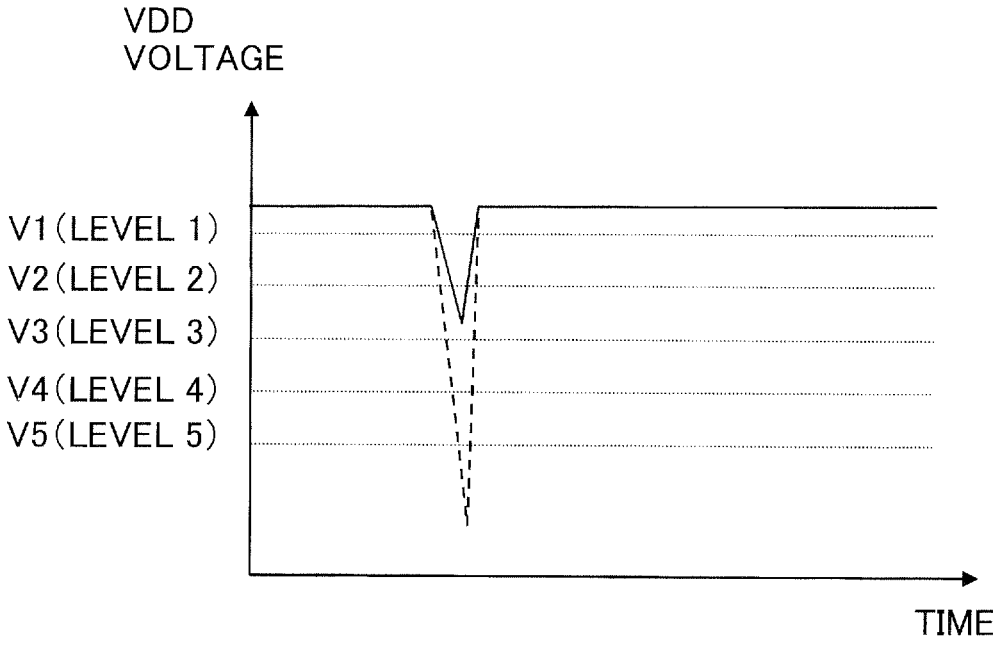
FIG. 9 is a graph showing a change of a supply voltage (VDD voltage) from a power supply at the time of applying a voltage to an active portion degrading in dielectric strength voltage.

FIG. 9 is a graph showing a change of the VDD voltage at the time of applying a voltage to an active portion 46 degrading in dielectric strength voltage. Because the more the dielectric strength voltage degrades in an active portion 46, the more the electric current flows through the active portion 46, as shown in FIG. 9 with the dashed line, the VDD voltage comes to drop to a higher degree.

Here, the comparator 48 inside the driver IC 47 compares the VDD voltage with a plurality of reference voltages (for example, five types of reference voltages V1 to V5) when the driver IC 47 applies the voltage only to one active portion 46 (the step S102 of FIG. 11). More specifically, the comparator 48 compares the VDD voltage with the five types of reference voltages V1 to V5 respectively to output either an L signal ("0") if the VDD voltage is equal to or higher than a reference voltage, or an H signal ("1") if the VDD voltage is lower than the reference voltage. With respect to each of the plurality of active portions 46, the VDD voltage is compared with the five types of reference voltages V1 to V5 (the step S103 of FIG. 11), and the comparison results outputted from the comparator 48 are stored collectively in the storage section 50 (the step S104 of FIG. 11).

On the other hand, the judgement circuit 49 of the control device 8 reads out the comparison results which are outputted from the comparator 48 after comparing the VDD voltage with the five types of reference voltages and stored in the storage section 50. Then, based on the comparison results, the judgement circuit 49 judges how much the dielectric strength voltage degrades, that is, the degradation level of dielectric strength voltage, for each of the plurality of active portions 46, and the judgement results are stored in the storage section 50 (the steps S105, S106 and S107 of FIG. 11).

In the embodiment, from the comparisons between the VDD voltage and the five types of reference voltages V1 to V5 at the time of applying the voltage only to one active portion 46, the degradation level of dielectric strength voltage is determined as below. Further, the following table 1 shows an example of the output results from the comparator 48 and the degradation levels of dielectric strength voltage judged based on the results.

V1 or above→Degradation level of dielectric strength voltage: 0 (normal);

V2 or above but under V1→Degradation level of dielectric strength voltage: 1;

V3 or above but under V2→Degradation level of dielectric strength voltage: 2;

V4 or above but under V3→Degradation level of dielectric strength voltage: 3;

V5 or above but under V4→Degradation level of dielectric strength voltage: 4; and Under V5→Degradation level of dielectric strength voltage: 5 (unusable due to short circuit between electrodes).

TABLE 1

| | Number of Nozzle (Active Portion) | | |
|---|---|---|---|
| Reference Voltage | No. 1 | No. 2 | No. 3 |
| V1 | 0 | 1 | 1 |
| V2 | 0 | 1 | 1 |
| V3 | 0 | 1 | 0 |
| V4 | 0 | 1 | 0 |
| V5 | 0 | 1 | 0 |
| Degradation Level of Dielectric Strength Voltage | Level 0 (Normal) | Level 5 (Unusable) | Level 2 |

The above table 1 shows the comparison signal (L signal "0" or H signal "1 ") with respect to the reference voltages outputted from the comparator, and the degradation levels of dielectric strength voltage in three active portions 46 (nozzles 30) at the time of applying the voltage to each of the three active portions 46 (No. 1 to No. 3) one by one. In the No. 1 active portion 46, the comparison signals are all "L" with respect to the five types of reference voltages. That is, the VDD voltage is V1 or above, and thus the degradation level of dielectric strength voltage is level 0 (normal) in this active portion 46. On the other hand, in the No. 2 active portion 46, the comparison signals are all "H" with respect to the five types of reference voltages. That is, as shown in FIG. 9 with the dashed line, the VDD voltage is even lower than V5 which is the lowest voltage value among the five types of reference voltages, and thus the degradation level of dielectric strength voltage is level 5 in this active portion 46, indicating an unusable state. That is, the dielectric strength voltage has degraded to such an extent that an almost complete short circuit occurs between the individual electrode 42 and the vibration plate 40 as the common electrode.

Further, in the No. 3 active portion 46, the comparison signals are "H" only with respect to V1 and V2. That is, as shown in FIG. 9 with the solid line, although the VDD voltage has dropped under V2, it is above V3, and thus the degradation level of dielectric strength voltage is level 2. That is, the No. 3 active portion 46 has not yet reached a state of complete short circuit. In this state, although the active portion 46 is still usable, it will finally fall into a state of short circuit (level 5) as the voltage application continues. In other words, it is possible to prolong the life of the active portion 46 by utilizing the active portion 46 in such a state while controlling the voltage application.

Further, in the embodiment, the driver IC 47 is provided on the inside with the comparator 48 for detecting the VDD voltage drop at the time of applying the voltage to one active portion 46. However, it is also possible to carry out the same judgement when the comparator is provided not on the side of the driver IC 47 but on the side of the control device 8. Nevertheless, as shown in FIG. 5, between the two power wires (high potential wire VDD and low potential wire VSS) connecting the control device 8 and the driver IC 47, a condenser C is generally provided to stabilize the supply voltage. Therefore, the change in supply voltage (VDD) occurring on the side of the driver IC 47 is smoothened by the condenser C and is difficult to be detected on the side of the control device 8 at the time of applying the voltage to an active portion 46 with degraded dielectric strength voltage. Accordingly, from the point of view of improving the detection accuracy, the embodiment is configured such that the comparator 48, and the storage section 50 for storing the comparison results are provided on the side of the driver IC 47 and the control device 8 reads out the comparison results of the comparator 48 from the storage section 50 and carries out judgement of the degradation level of dielectric strength voltage in each active portion 46.

Further, at the time of carrying out judgement of the degradation level of dielectric strength voltage, because the driver IC 47 applies the voltage to the active portions 46 one by one, it is also conceivable that liquid droplets may be jetted from the nozzles 30 depending on the application voltage. Therefore, it is preferable to carry out judgement of the degradation level of dielectric strength voltage in the active portions 46 under such a condition as no problems may occur even if liquid droplets are jetted. For example, with respect to an ink-jet printer, in order to prevent the nozzles 30 from drying before or while carrying out printing on the recording paper 100, it is common to perform a so-called flushing operation, in which the ink-jet head 3 is moved to a position which does not face the recording paper 100 (such as both end positions in the left-right direction, i.e., the scanning direction in FIG. 1) and liquid droplets are jetted from the ink-jet head 3 at that position. Accordingly, the judgement for the active portions 46 may be carried out by applying the voltage to each of the plurality of active portions 46 during the above-mentioned flushing time that the nozzles 30 do not face the recording paper 100, and thus no problems may occur even if liquid droplets are jetted by any chance.

Further, at the time of judging the degradation level of dielectric strength voltage described hereinabove, the voltage applied to the active portions 46 may be the drive voltage (the voltage level of the drive pulse signals) at the time of actually driving the active portions 46, or may also be a voltage different from the drive voltage. If the voltage to be applied at the above-mentioned judgement time is set to be lower than the drive voltage, it is possible to prevent liquid droplets from being jetted during the examination time. On the contrary, if the voltage at the judgement time is set to be higher than the drive voltage, the degree of the supply voltage drop will become conspicuous at the time of applying the voltage to the active portions 46 with degraded dielectric strength voltage, thereby improving the detection accuracy.

Further, in the embodiment, the configuration, which is composed of the piezoelectric actuator 7, the driver IC 47 (drive device) for driving the piezoelectric actuator 7, the comparator 48 (comparison section) incorporated in the driver IC 47, and the judgement circuit 49 (judgement section) provided in the control device 8, corresponds to the piezoelectric actuator apparatus of the present invention.

The head control circuit 81 of the control device 8 refers to the degradation level of dielectric strength voltage of each active portion 46 judged by the judgement circuit 49 and stored in the storage section 50, and carries out control of the driver IC 47 to restrain the dielectric strength voltage from further degrading. In particular, when the degradation level of dielectric strength voltage exceeds a predetermined level in an active portion 46, that is, when the degradation of dielectric strength voltage advances to a certain extent or more, such a measure as below is taken to restrain the degradation of dielectric strength voltage. Further, the predetermined level described hereinabove may be appropriately determined in view of the contents of the restraint measure described hereinbelow, the influence on printing (degradation in print quality) at the time of carrying out the measure, and the like. For example, it is possible to set the predetermined level at level 1 (when the VDD voltage has dropped under V1 in FIG. 9), which is the level at the time of discovering an inclination of the degradation of dielectric strength voltage in an active portions 46 for the first time.

The more (the number of times of applying the voltage) an active portion 46 is driven, or the longer the voltage is applied, the more the degradation of dielectric strength voltage advances in that active portion 46. In view of this, when the degradation level of dielectric strength voltage is judged as having exceeded the predetermined level in a certain active portion 46, comparison is made with the case of not exceeding the predetermined level, and the number of times of driving the active portion 46 (the number of times of applying the voltage) is restricted to a smaller number within a certain period, or the time of applying the voltage is restricted to a shorter time. That is, even though it is required to drive an active portion 46 a large number of times within a certain period, or to apply the voltage to the active portion 46 for a, long time, with respect to the active portion 46 degrading in dielectric strength voltage, from the point of view of life prolongation, the number of drives is restricted to be small, or the time of voltage application is restricted to be short. Hereinbelow, a few specific examples will be given.

In a case of carrying out printing on one sheet of the recording paper 100, the number of driving of one active portion 46 (the number of jetting liquid droplets of the corresponding nozzle 30) is determined by the image data inputted from the PC 79. Further, according to the number of driving, the total time of applying the voltage to the active portion 46 during printing the one sheet of the recording paper 100 is also determined for.

In view of this, with respect to an active portion 46 in which the degradation level of dielectric strength voltage exceeds a predetermined level, the number of driving (the time of voltage application) is reduced to be less than the number of driving determined from the image data. That is, the number of jetting liquid droplets from the nozzle 30 corresponding to that active portion 46, i.e., the number of dots to be formed on the recording paper 100 by that nozzle 30 is reduced. In such cases, some liquid droplets are not jetted to the positions where dots should have been formed. As a result, since dots are partially thinned out, print quality may degrade more or less. However, since the number of driving (drive frequency) or time of voltage application is reduced, it is possible to prolong the life of the active portions 46 degrading in dielectric strength voltage.

In the embodiment, each active portion 46 is supplied with one drive pulse signal selected from the three types of drive pulse signals (FIGS. 6A to 6C) for jetting the three types of liquid droplets different in size (large droplet, medium droplet, and small droplet), respectively, based on the image data inputted from the PC 79. As shown in FIGS. 6A to 6C, the three types of drive pulse signals differ in the number of pulses, that is, the number of voltage applications to an active portion 46 per print period. Further, if there is no great difference in the width of each pulse, as the number of pulses is increased, the time of voltage application per print period at the time of applying one drive pulse signal becomes longer. In view of this, in the same manner as described above, from the point of view of reducing the number of driving of the active portions 46 degrading in dielectric strength voltage (shortening the time of voltage application) within a certain period, it is also preferable to apply a drive pulse signal with less pulses to the active portions 46 degrading in dielectric strength voltage, rather than the drive pulse signal selected for each active portion 46 based on the image data. For example, even in the case of selecting the drive pulse signal for large droplets based on the image data for a certain active portion 46, if the degradation level of dielectric strength voltage has exceeded a predetermined level in that active portion 46, the driver IC 47 applies a drive pulse signal for jetting medium or small droplets in which smaller number of pulses are included.

Further, FIGS. 6A to 6C show an example of the three types of drive pulse signals with the same pulse width. However, when it is possible to utilize a plurality of types of drive pulse signals identical in pulse number but different in pulse width (that is, the time of voltage application), it is also possible to apply a drive pulse signal with a narrow pulse width to the active portions 46 degrading in dielectric strength voltage to shorten the time of voltage application within one print period.

Since the degradation of dielectric strength voltage in an active portion 46 advances more quickly when a higher voltage is applied to the active portion 46, the voltage applied to such active portions 46 may also be lowered in comparison with the normal active portions 46. In particular, the driver IC 47 is configured to be able to select one type of a plurality of types of voltage levels as the voltage to apply to each active portion 46, and to be able to adjust the pulse height (application voltage) of the drive pulse signal for each active portion 46. Further, while there is no specific limitation on the configuration of the circuit for generating the plurality of types of voltage levels, it is possible to adopt such a circuit configuration as to acquire a plurality of types of voltage levels equal to or under the VDD voltage level by dividing the VDD voltage into a plurality of levels with a plurality of impedances arranged in series between the VDD (high potential wire) and the VSS (low potential wire). Then, for the active portions 46 with the degradation level of dielectric strength voltage over a predetermined level, the driver IC 47 selects a drive voltage lower than that for the normal active portions 46 so as to supply the drive pulse signal with a low pulse height.

As explained hereinabove, in the embodiment, by judging the degradation degree of dielectric strength voltage at a plurality of levels for each of the plurality of active portions 46, it is possible to take measures for the active portions 46, which are degrading in dielectric strength voltage but have not yet been completely short-circuited, to restrain the degradation of the active portions 46 in dielectric strength voltage and thereby prolonging the life of the active portions 46.

Next, explanations will be made with respect to a few modifications which apply various changes to the embodiment. However, it should be appreciated that the constitutive parts or components, which are the same as or equivalent to those of the embodiment, are designated by the same reference numerals, any explanation of which will be omitted as appropriate.

In the embodiment, the degradation degree of dielectric strength voltage is judged for each of the plurality of active portions 46. However, for example, it may also be judged for each group of active portions 46 corresponding to the plurality of nozzles included in one nozzle row. In particular, the supply voltage from the power supply to the driver IC 47 is compared with a plurality of types of reference values at the time of applying the voltage to a group of active portions 46 corresponding to the plurality of nozzles included in one nozzle row and, based on the comparison results, the judgement circuit 49 may judge the degradation degree of dielectric strength voltage in the group of active portions 46 corresponding to the one nozzle row at a plurality of levels. In such cases, because it is possible to judge the degradation degree of dielectric strength voltage in the group of active portions 46 corresponding to each nozzle row, it is possible to take an appropriate measure for each nozzle row.

Further, in the embodiment, from the comparisons between the VDD voltage and the five types of reference voltages V1 to V5 at the time of applying the voltage only to one active portion 46, the degradation level of dielectric strength voltage is judged at five levels. However, it is also possible to take such measures as to compare the VDD voltage with one predetermined reference voltage, judge that the dielectric strength voltage is degrading in the one active portion 46 if the VDD voltage is lower than the reference voltage, and reduce the number of voltage applications to the one active portion 46 or shorten the time of voltage application, and the like.

At the time of applying the voltage only to one active portion 46 with degraded dielectric strength voltage, abnormal signs may appear not only in the supply voltage from the power supply (VDD) but also in the electric current flowing between the power supply and the driver IC 47 (piezoelectric actuator 7). That is, almost no electric current flows in the active portions 46 in a normal state, whereas an electric current keeps flowing in the active portions 46 degrading in dielectric strength voltage throughout the period of voltage application. That is, the electric current keeps flowing between the power supply and the driver IC 47 (piezoelectric actuator 7). Further, the more the dielectric strength voltage degrades in an active portion 46, the more the electric current flows through the active portion 46. In view of this, at the time of applying the voltage only to one active portion 46, the comparator 48 may also compare the electric current (flowing through the VDD or VSS of FIG. 5) flowing between the power supply and the driver IC 47 (piezoelectric actuator 7) with a plurality of types of reference current values and, based on the comparison results, the judgement circuit 49 may judge the degradation degree of dielectric strength voltage in that active portion 46 at a plurality of levels.

Figure 10A:
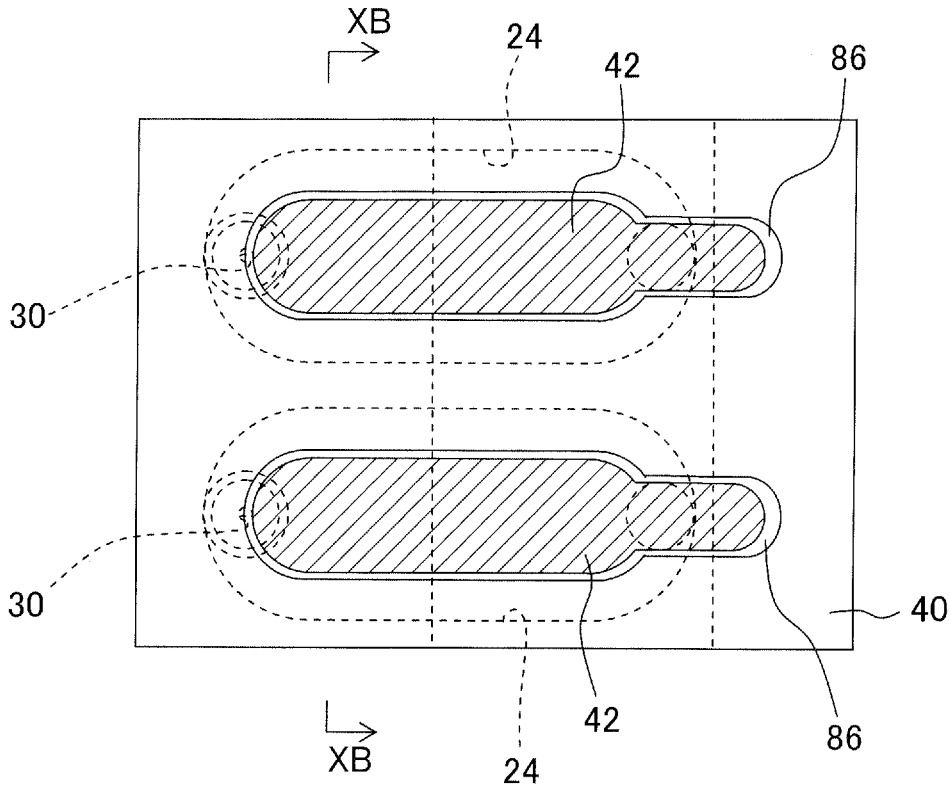
FIG. 10A is a partial enlarged plan view of an ink-jet head corresponding to FIG. 3 to show the ink-jet head in accordance with a modification.
Figure 10B:
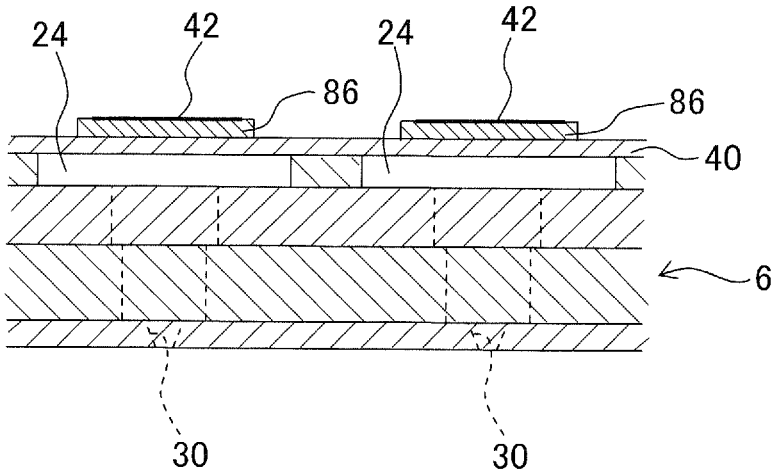
FIG. 10B is a cross-sectional view taken along the line X B-X B of FIG. 10A.

In the embodiment, adjacent active portions 46 (piezoelectric elements) are connected via the surrounding piezoelectric layer 41. However, as shown in FIGS. 10A and 10B, it is also possible to apply the present invention, in the same manner as the embodiment, to the case of arranging active portions 86 (piezoelectric elements) sandwiched respectively between two types of electrodes to be separate from each other.

In the embodiment, the piezoelectric actuator is configured to jet ink droplets from the corresponding nozzle by changing each piezoelectric element from a standby state under no voltage application to a state under a voltage application. However, it may also be configured to jet ink droplets from the corresponding nozzle by once releasing each piezoelectric element from a standby state under a voltage application and then putting the each piezoelectric element back again into the state under the voltage application.

The piezoelectric actuator which is an object of applying the present invention is not limited to that of an ink-jet head for jetting liquid droplets from nozzles. For example, it is also possible to apply the present invention to actuators for applying a pressure to liquids other than inks and, furthermore, to actuators for driving a solid object.

What is claimed is:

1. A piezoelectric actuator apparatus which is connectable to a power supply, the apparatus comprising:

a piezoelectric actuator which is provided with a plurality of piezoelectric elements each of which is sandwiched by two types of electrodes;

a drive device which is connected to the power supply to drive each of the piezoelectric elements by applying drive pulse signals;

a comparison section which compares a predetermined reference value with one of a supply voltage from the power supply to the drive device and an electric current flowing between the power supply and the drive device under the condition that the drive device applies the drive pulse signals to at least one piezoelectric element of the piezoelectric elements; and a judgement section which judges a degradation degree of dielectric strength voltage for the at least one piezoelectric element based on a comparison by the comparison section, wherein the drive device is provided with the comparison section and a storage section for storing a comparison result outputted from the comparison section.

2. The piezoelectric actuator apparatus according to claim 1, wherein the reference value includes a plurality of types of reference values, the comparison section compares the plurality of types of reference values with one of the supply voltage from the power supply to the drive device and the electric current flowing between the power supply and the drive device, and the judgement section judges the degradation degree of dielectric strength voltage at a plurality of levels based on the comparison by the comparison section.

3. The piezoelectric actuator apparatus according to claim 2, wherein under the condition that the judgement section judges that the degradation degree of dielectric strength voltage exceeds a predetermined level in one piezoelectric element among the piezoelectric elements, the drive device restricts the number of times of driving the one piezoelectric element within a certain period to a smaller number than the number of times of driving the one piezoelectric element within the certain period in a state that the degradation degree of dielectric strength voltage does not exceed the predetermined level.

4. The piezoelectric actuator apparatus according to claim 2, wherein under the condition that the judgement section judges that the degradation degree of dielectric strength voltage exceeds a predetermined level in one piezoelectric element among the piezoelectric elements, the drive device restricts a time period of applying the drive pulse signals to the one piezoelectric element within a certain period to a shorter time period than the time period of applying the drive pulse signals to the one piezoelectric element within the certain period in a state that the degradation degree of dielectric strength voltage does not exceed the predetermined level.

5. The piezoelectric actuator apparatus according to claim 2, wherein under the condition that the judgement section judges that the degradation degree of dielectric strength voltage exceeds a predetermined level in one piezoelectric element among the piezoelectric elements, the drive device reduces a voltage to be applied between the two types of electrodes at the time of driving the one piezoelectric element to a lower voltage than the voltage to be applied between the two types of electrodes at the time of driving the one piezoelectric element in a state that the degradation degree of dielectric strength voltage does not exceed the predetermined level.

6. An ink-jet printer which is connectable to a power supply and which jets ink droplets to a recording medium, the ink-jet printer comprising:

an ink-jet head including a flow passage unit which has a plurality of nozzles for jetting the ink droplets toward the recording medium and ink flow passages communicating with the nozzles, and a piezoelectric actuator which is provided on the flow passage unit and which has a plurality of piezoelectric elements each of which is sandwiched by two types of electrodes to cause the ink droplets to be jetted from the nozzles;

a drive device which is connected to the power supply to drive each of the piezoelectric elements by applying drive pulse signals;

a comparison section which compares a predetermined reference value with one of a supply voltage from the power supply to the drive device and an electric current flowing between the power supply and the drive device under the condition that the drive device applies the drive pulse signals to at least one piezoelectric element of the piezoelectric elements; and a judgement section which judges a degradation degree of dielectric strength voltage for the at least one piezoelectric element based on a comparison by the comparison section, the drive device is provided with the comparison section and a storage section for storing a comparison result outputted from the comparison section.

7. The ink-jet printer according to claim 6, wherein the reference value includes a plurality of types of reference values, the comparison section compares the plurality of types of reference values with one of the supply voltage from the power supply to the drive device and the electric current flowing between the power supply and the drive device, and the judgement section judges the degradation degree of dielectric strength voltage at a plurality of levels based on the comparison by the comparison section.

8. The ink-jet printer according to claim 7, wherein under the condition that the judgement section judges that the degradation degree of dielectric strength voltage exceeds a predetermined level in one piezoelectric element among the piezoelectric elements, the drive device reduces the number of times of driving the one piezoelectric element during printing on one sheet of the recording medium to a smaller number than the number of times of driving the one piezoelectric element during the printing on the one sheet of the recording medium in a state that the degradation degree of dielectric strength voltage does not exceed the predetermined level, so as to reduce the number of times of jetting the ink droplets from the nozzle corresponding to the one piezoelectric element.

9. The ink-jet printer according to claim 6, wherein the drive device drives each of the piezoelectric elements by changing application voltage by applying a plurality of types of drive pulse signals each of which has a pulse with a predetermined voltage level and which are different in pulse number within one drive period; the drive device is configured to select one drive pulse signal of the drive pulse signals and apply the one drive pulse signal to each of the piezoelectric elements so that sizes of the ink droplets to be jetted from each of the nozzles are changed; and under the condition that the judgement section determines that the degradation degree of dielectric strength voltage exceeds a predetermined level in one piezoelectric element among the plurality of piezoelectric elements, the drive device selects a drive pulse signal and applies the drive pulse signal to the one piezoelectric element so that the pulse number included in the drive pulse signal is less than the pulse number included in the drive pulse signal to be selected in a state that the degradation degree of dielectric strength voltage does not exceed the predetermined level.

10. The ink-jet printer according to claim 6, wherein in a flushing in which the ink droplets are jetted from the nozzles in a state of not facing the recording medium, the drive device applies the drive pulse signals to the piezoelectric elements respectively, and the judgement section judges the degradation degree of dielectric strength voltage for each of the piezoelectric elements.

11. The ink-jet printer according to claim 6, wherein the drive device is provided in the ink-jet head and is connected to the power supply via a control device for controlling the drive device; a condenser is provided to stabilize the supply voltage from the power supply to the drive device between a high potential wire and a low potential wire which are power wires connecting the control device and the drive device; the judgement section is provided in the control device, reads out the comparison result stored in the storage section provided in the drive device, and judges the degradation degree of dielectric strength voltage for each of the plurality of piezoelectric elements; and the control device controls the drive device based on a judgement result of the judgement section.

12. The ink-jet printer according to claim 6, wherein the drive device is configured to apply a first voltage between the two types of electrodes, in a state that the ink-jet head jets the ink droplets toward the recording medium, and wherein the drive device is configured to apply a second voltage, which is set to be lower than the first voltage, between the two types of electrodes, under a condition that the judgment section judges the degradation degree of dielectric strength voltage for each of the piezoelectric elements.

13. The ink-jet printer according to claim 6, wherein the drive device is configured to apply a first voltage between the two types of electrodes, in a state that the ink-jet head jets the ink droplets toward the recording medium, and wherein the drive device is configured to apply a second voltage, which is set to be higher than the first voltage, between the two types of electrodes, under a condition that the judgment section judges the degradation degree of dielectric strength voltage for each of the piezoelectric elements.

* * * * *